US007108445B2

(12) United States Patent
Henriques

(10) Patent No.: US 7,108,445 B2
(45) Date of Patent: Sep. 19, 2006

(54) ADAPTOR FOR A MAILBOX POST

(75) Inventor: Joseph Henriques, New Milford, CT (US)

(73) Assignee: Joseph Henriques, Jr., New Milford, CT (US)

( * ) Notice: Subject to any disclaimer, the term of this patent is extended or adjusted under 35 U.S.C. 154(b) by 145 days.

(21) Appl. No.: 10/766,699

(22) Filed: Jan. 28, 2004

(65) Prior Publication Data

US 2004/0228677 A1 Nov. 18, 2004

Related U.S. Application Data

(60) Provisional application No. 60/444,298, filed on Jan. 31, 2003.

(51) Int. Cl.
*E21B 19/16* (2006.01)

(52) U.S. Cl. ..... 403/202; 403/229; 403/203; 403/220; 403/223; 403/291; 248/160; 248/900; 248/623

(58) Field of Classification Search ..... 232/39; 403/229, 372, 202, 203, 220, 223, 291, 2, 403/23, 53; 248/160, 900, 548, 623; 267/178, 267/179, 160
See application file for complete search history.

(56) References Cited

U.S. PATENT DOCUMENTS 2,149,050 A * 2/1939 Hajicck ..... 248/145
4,995,576 A * 2/1991 Kieswetter ..... 248/145
5,160,111 A * 11/1992 Hugron ..... 248/548
5,297,570 A * 3/1994 Conner ..... 135/16
5,524,858 A * 6/1996 Friend ..... 248/548
5,678,945 A * 10/1997 Fimeri ..... 403/92
5,803,353 A * 9/1998 Fisher ..... 232/39
6,223,982 B1 5/2001 Dunn
6,267,529 B1 * 7/2001 Mudryk et al. ..... 404/10
6,328,047 B1 * 12/2001 Lee ..... 135/20.1
6,810,890 B1 * 11/2004 Lin et al. ..... 135/16

* cited by examiner

*Primary Examiner*—Daniel P. Stodola
*Assistant Examiner*—Nahid Amiri

(57) ABSTRACT

An adapter is for use in cooperation with a post. The adapter includes an upper adapter portion which will be attached to a first part of the post, and a lower adapter portion which will be attached to a second part of the post. The adapter also includes a cylindrically helical spring connecting the upper adapter portion to the lower adapter portion so as to allow relative movement between the upper and lower adapter portions, including either rotational movement in which the post remains upright, or movement in which the first part of the post bends, or both. At least one of the two adapter portions is shaped to receive the helical spring as a screw.

14 Claims, 6 Drawing Sheets

FIG.2
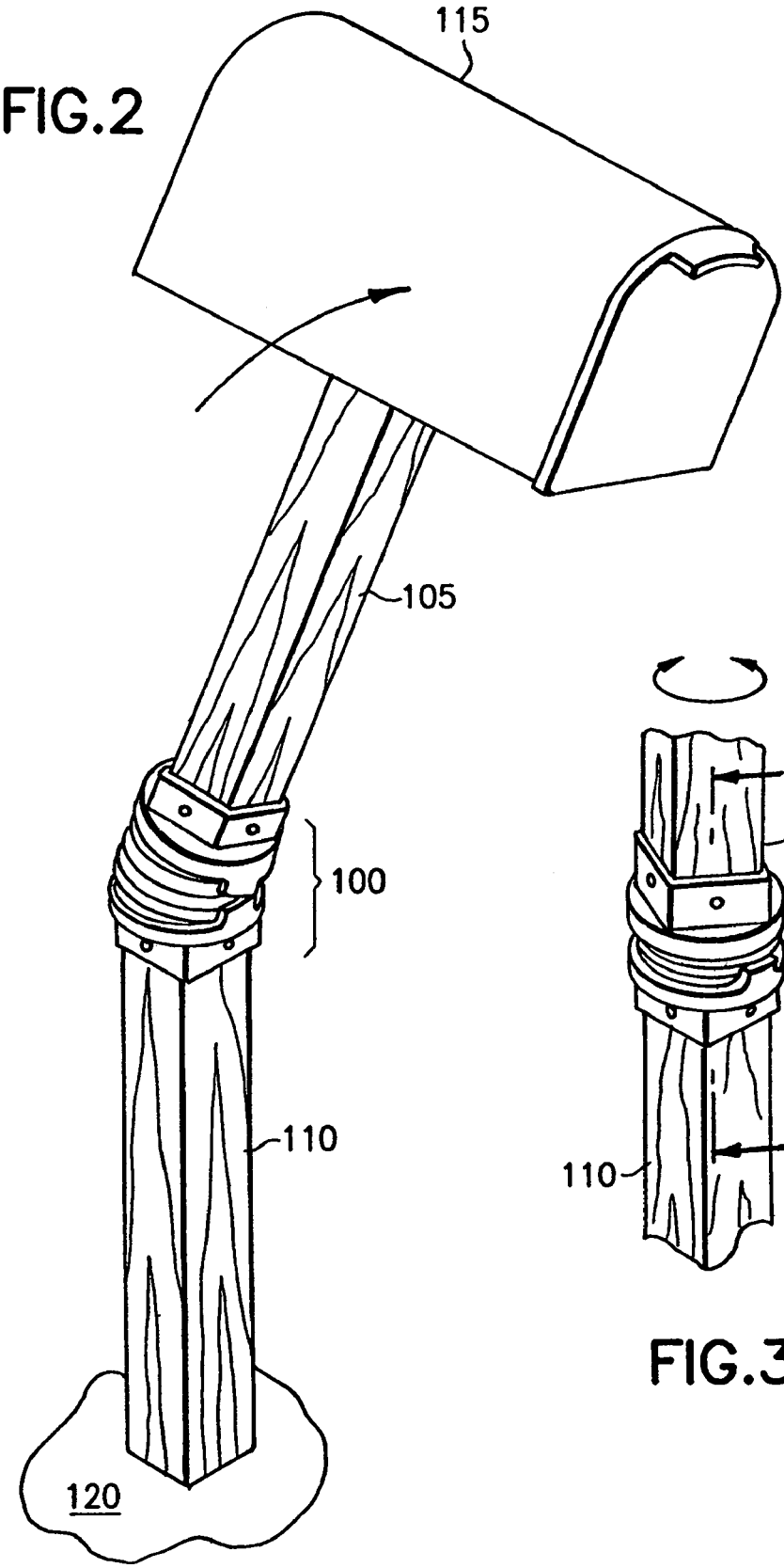
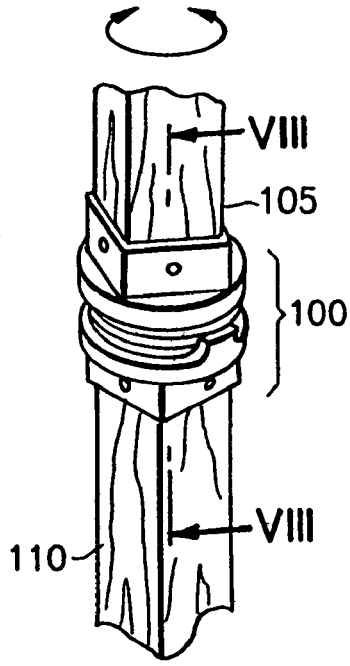
FIG.3

ADAPTOR FOR A MAILBOX POST

This application claims the benefit of U.S. Provisional Application No. 60/444,298, filed Jan. 31, 2003.

FIELD OF THE INVENTION

The present invention relates to outdoor mailboxes, and in particular to outdoor mailboxes that rest upon a vertical post.

BACKGROUND OF THE INVENTION

Outdoor mailboxes typically are positioned close to roads. Therefore, such a mailbox is susceptible to being hit by a motor vehicle, or by other objects such as snow plowed by a snowplow, or even by vandals. The mailbox post is then vulnerable to being broken.

It is known to configure a mailbox post so that it has a flexible joint, thereby allowing the mailbox post to bend rather than break. See Dunn (U.S. Pat. No. 6,223,982). Dunn discloses installing a non-circular spring wire between the upper and lower parts of the mailbox post, the spring being positioned vertically, so that the mailbox post will return to a vertical position after being hit.

However, there are several drawbacks to Dunn's configuration. First, Dunn does not disclose that the spring unit is distinct from the post, and thus if any part of Dunn's post becomes damaged then the entire thing (including the joint) either becomes useless or must be repaired. Likewise, the invention of Dunn replaces an existing mailbox post, instead of being adaptable to an existing mailbox post.

Also, Dunn requires a non-circular elastic element in order for the mailbox post to properly align with a horizontal axis, but such a spring is not as strong and durable as a circular spring. This non-circular elastic element also makes assembly and disassembly difficult, while putting great stress on the parts that secure the non-circular spring to the rest of the mailbox post. Moreover, the tension of Dunn's elastic piece is not adjustable.

SUMMARY OF THE INVENTION

The present invention is an adapter that can be inserted into a mailbox post in order to provide flexibility. The adapter can also be removed from the mailbox post, and installed in a different mailbox post.

The adapter includes an upper adapter portion which will be attached to a first part of the mailbox post, and a lower adapter portion which will be attached to a second part of the mailbox post. The two parts of the mailbox post can be formed by simply cutting a whole mailbox post into two pieces, each of which will be received by one of the adapter portions.

The adapter also includes a cylindrically helical spring connecting the upper adapter portion to the lower adapter portion so as to allow relative movement between the upper and lower adapter portions. This relative movement can be either rotational movement in which the mailbox post remains upright, or movement in which the first part of the mailbox post bends with respect to the second part of the mailbox post, or both. In any case, the spring will cause the mailbox post to return to its unbent or unrotated configuration.

At least one of the two adapter portions is shaped to receive the helical spring as a screw. Using the cylindrically helical spring as a screw has several advantages, such as securing the spring very securely once it is screwed into place, and providing a stronger and more durable spring that is relatively expensive. The spring will not become unscrewed during rotational motion, because the spring can be secured in place once it is screwed in.

According to an embodiment of this invention, the adapter is dimensioned for insertion into a mailbox post, or vice versa. The general purpose of such an adapter would be to ensure that the mailbox post is flexible rather than rigid, and thus the post could withstand impacts from, for example, being hit by a car or truck. The adapter has an upper portion and a lower portion connected by the spring which fits into a hole in the top part and/or the bottom part. The hole has a diameter for accommodating the spring. The spring can, for example, be the same type of spring used to operate a garage door. The upper portion of the adapter includes a space in which the first part of the mailbox post can be inserted and then secured using screws. The lower portion of the adapter has a similar arrangement. Connecting the lower portion of the adapter to the upper portion is the spring, which can be screwed into both adapter portions, or be attached to one part for screwing into the other part.

In this embodiment, the upper and lower portions of the adapter may have protruberances and matching indentations to ensure that the bottom part and the top part will tend to stay properly aligned after they are screwed together. Thus, when the adapter is screwed together, two surfaces will be facing each other, and the bumps and indentations of those surfaces will match up. When the mailbox post is bent over, it need not break, and it will be able to bounce back to its vertical position. This embodiment of the invention further comprises a shield (e.g. a duct or the like) that can be used to surround the adapter so that snow and dirt (or fingers) will not come between the top part of the adapter and the bottom part.

The invention may also include a bracing piece. This bracing piece is not always necessary, but can sometimes be useful, especially for large mailbox posts, or mailbox posts that support a particularly heavy mailbox. The upper end of the bracing piece would be attached to the upper part of the mailbox post, with the lower end of the bracing piece shaped so as to fit with the lower portion of the adapter. The lower portion of the adapter then includes a slot or hole for fitting with the lower end of the bracing piece. A ball is embedded in the brace, and this ball fits snugly into the slot or hole. This arrangement allows for the ball to be knocked out of the hole in the adapter, but then the ball can roll back into the hole when the post returns to its vertical and aligned configuration. Of course, the reverse arrangement might be possible, with the upper portion of the adapter having the slot or hole, instead of the lower portion of the adapter. Likewise, the ball could be embedded in the adapter, and the corresponding hole or indentation could be located in the brace, although the reverse is preferable.

BRIEF DESCRIPTION OF THE DRAWINGS

FIG. 2 is a view of the adapter installed in the mailbox post, in a bent over unrotated position.

FIG. 3 is a view of the adapter installed in the mailbox post when the mail box post is partly rotated instead of bent over.

DETAILED DESCRIPTION OF THE INVENTION

Figure 1:
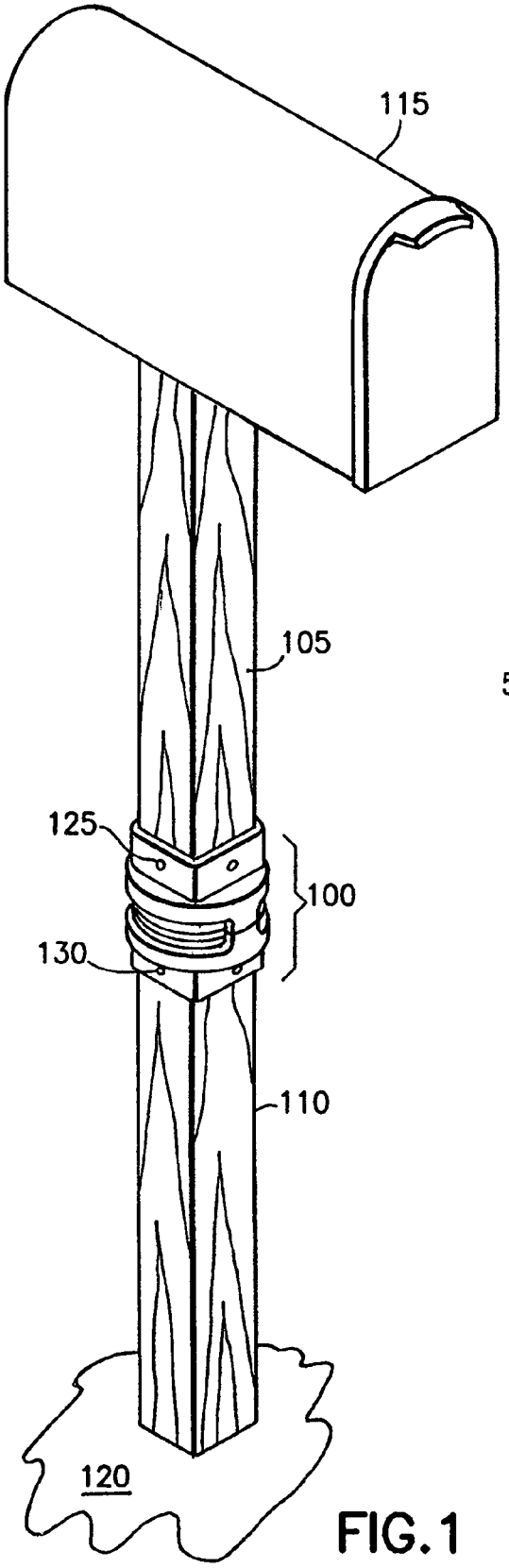
FIG. 1 is a view of the adapter installed in the mailbox post, in an erect unrotated position.

As seen in FIG. 1, an adapter 100 is for use in cooperation with a mailbox post that has a first part 105 and a second part 110. The mailbox post supports a mailbox 115, and the second part 110 is planted in the ground 120. The purpose of the adapter 100 is to allow the first part 105 of the mailbox post to bend over, as seen in FIG. 2, and to also allow the first part 105 to rotate with respect to the second part 110, as seen in FIG. 3.

FIG 1 further shows that the adapter includes a plurality of holes such as holes 125 and 130 for removably screwing or nailing the adapter to the mailbox post. The adapter 100 is shaped to receive the first part 105 and the second part 110 of the mailbox post.

Figure 4:
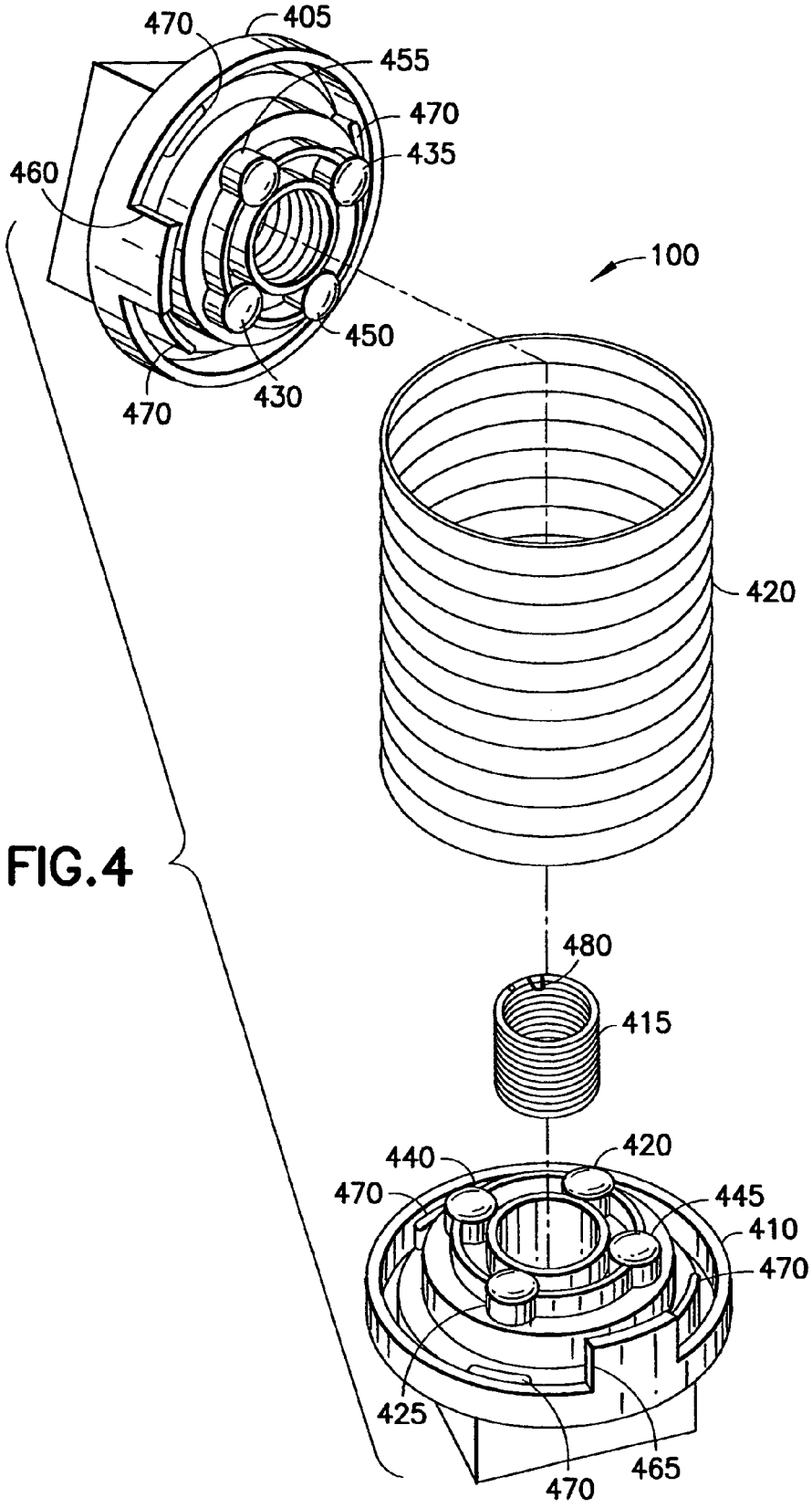
FIG. 4 is an exploded view of the adapter.

FIG. 4 is an exploded view showing the adapter 100 in greater detail, including an upper adapter portion 405 for attachment to the first part 105 of the mailbox post, a lower adapter portion 410 for attachment to the second part 110 of the mailbox post, and a cylindrically helical spring 415 for connecting the upper adapter portion to the lower adapter portion so as to allow relative movement between the upper and lower adapter portions if a force is applied to the first part of the mailbox post. The spring has a hook or bend 480 which has a function that will become more apparent in FIG. 8. The adapter portions can, in a preferable embodiment, be made of polycarbonate plastic, and can accommodate a mailbox post having a width of 3.5" and a depth of 3.5" (any other size post can be used with this adapter if the post and the adapter are connected by a mating piece). In FIG. 4, the upper adapter portion 405 is shaped to receive the helical spring 415 as a screw, whereas the helical spring is secured to the lower adapter portion by other means, such as glue, caulk (e.g. PL. Polyurethane), or a grommet. The adapter 100 further includes a shield 420 for encircling and protecting at least the helical spring, and shield wedges 470 for ensuring that the shield fits snugly and securely into the adapter portions 405 and 410. The shield not only prevents dirt or pebbles from interfering with the operation of the adapter, but also prevents children and others from getting their fingers caught between the upper adapter portion 405 and the lower adapter portion 410. FIG. 4 also shows that the upper adapter portion 405 and the lower adapter portion 410 have facing surfaces which include a plurality of protruberances 430, 435, 440, and 445, as well as corresponding indentations 420, 425, 450, and 455 for flexibly aligning the adapter portions. Thus, the upper adapter portion 405 is identical to the lower adapter portion 410, and can be manufactured from the same mold. FIG. 4 further shows that the upper adapter portion 405 and the lower adapter portion 410 have respective facing elements 460 and 465 located outside the shield 420, for preventing the mailbox post from bending in a direction of the facing elements. These facing elements would normally be located near a road, so that the mailbox post will be inhibited from bending toward the road.

Figure 5:
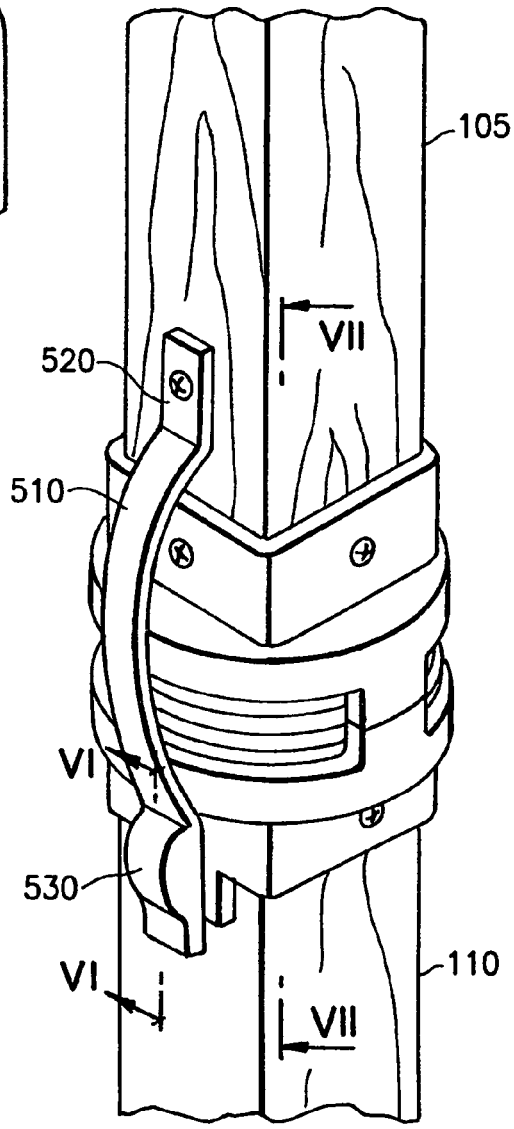
FIG. 5 is a view of the adapter installed in the mailbox post in an erect unrotated position, including a brace.
Figure 6:
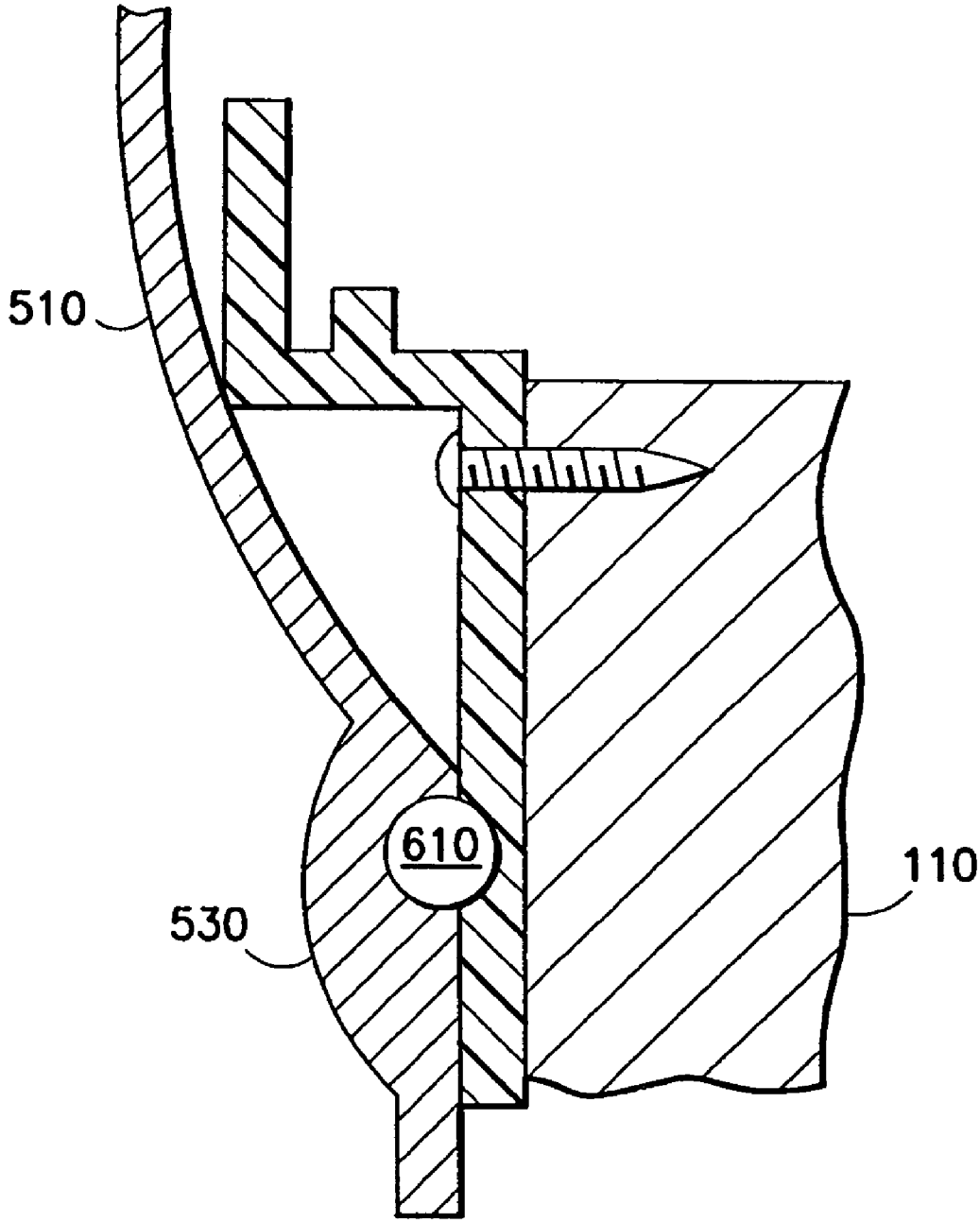
FIG. 6 is a cross-sectional view along the line VI shown in FIG. 5.

Turning now to FIG. 5, a bracing piece 510 is shown, the bracing piece having an end 520 that is securable to the first part of the mailbox post 105, and the bracing piece also having a protruberance at the other end 530 of the bracing piece that is alignable with a corresponding indentation in the lower adapter portion. This is further shown in the cross-sectional view of FIG. 6, where the protruberance 610 is a ball protruding from the bracing piece 510. Of course, it is also possible for the protruberance to protrude from the mailbox post instead of from the bracing piece, and/or for the protruberance to be in contact with the first part 105 of the mailbox post instead of the second part 110. The main purpose of the brace is to inhibit the post from bending in a particular direction, and this can alternatively or additionally be accomplished by the facing elements 460 and 465.

Figure 7:
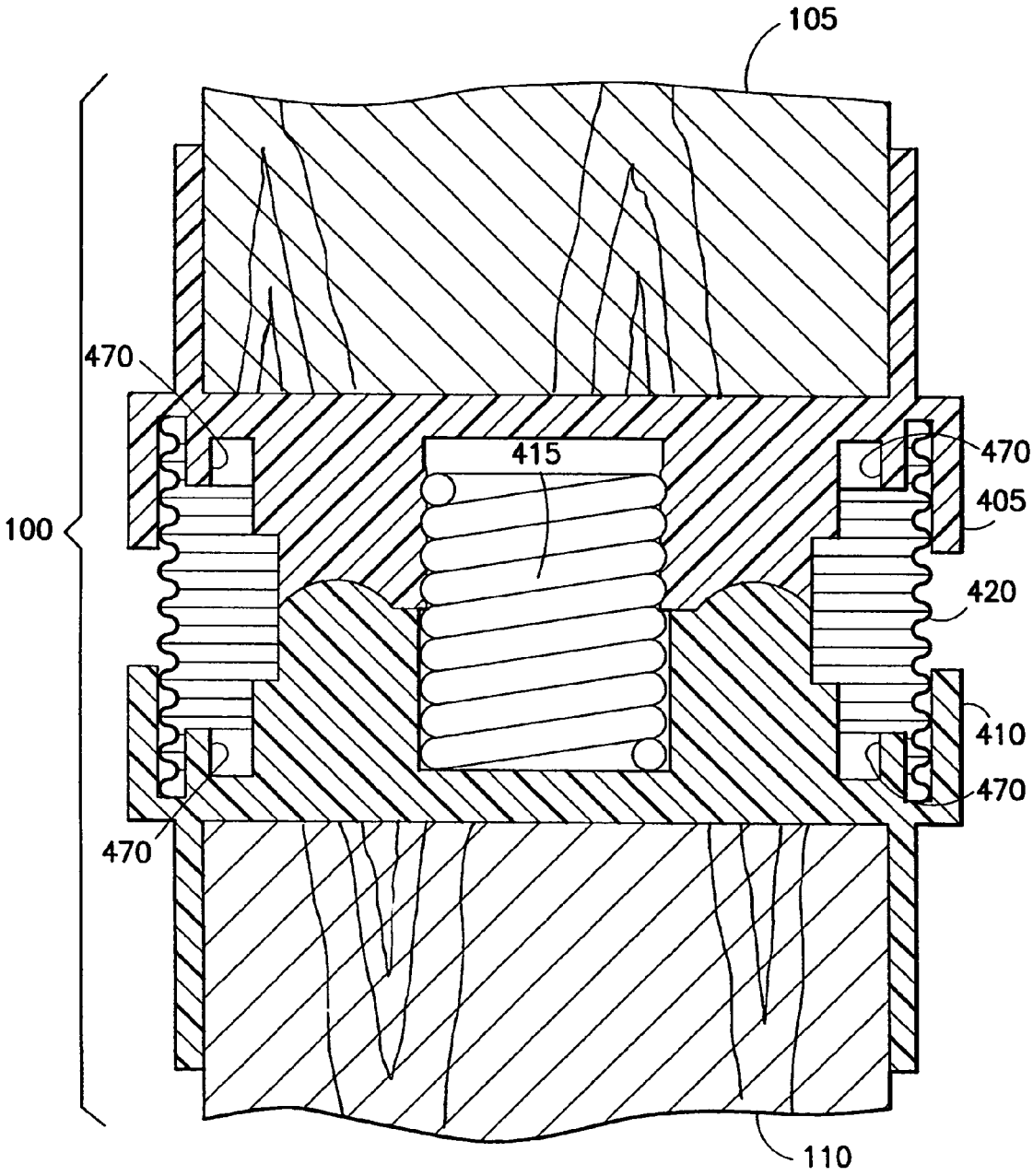
FIG. 7 is a cross-sectional view along the line VII shown in FIG. 5.
Figure 8:
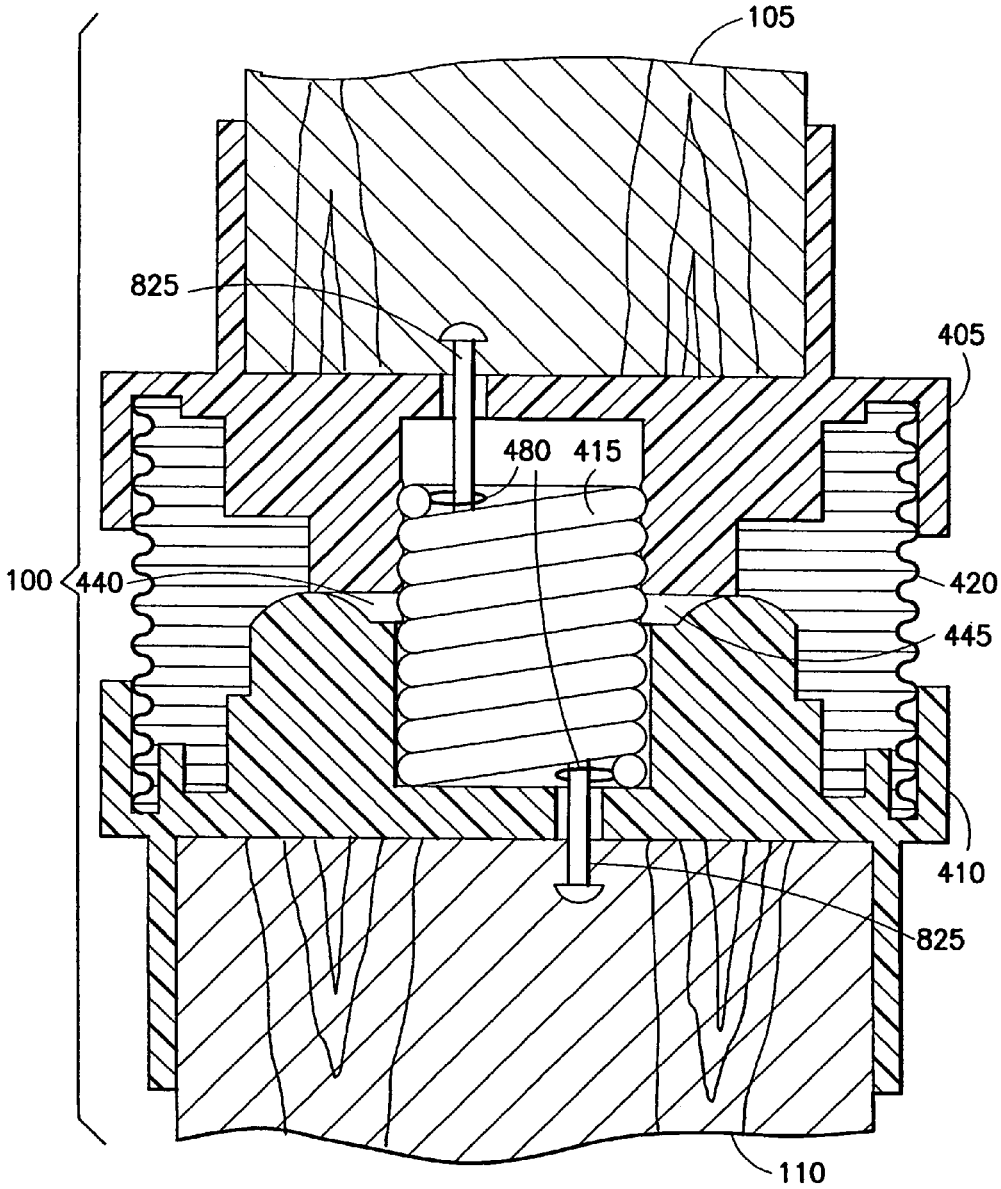
FIG. 8 is a cross-sectional view along the line VIII shown in FIG. 3.

FIG. 7 is a cross sectional view showing the adapter installed in the mailbox post, when the post is erect and unrotated. In this case, the protruberances are nested in the corresponding indentations, and therefore the upper adapter portion 405 is closely positioned against the lower adapter portion 410. In contrast, as shown in FIG. 8, when the post is rotated the protruberances 440 and 445 push the upper and lower adapter portions away from each other. This pushing away will not occur, however, unless the protruberances are dislodged from the respective indentations, which can only happen when the force applied to the first part of the mailbox 105 post creates a torque between the upper 405 and lower 410 adapter portions greater than a pre-determined amount. That predetermined amount will depend upon how much tension is in the spring 415, which in turn depends upon how far the spring is screwed in.

FIG 8 further shows a removable device 825 for securing the spring 415 in a screwed position. In this embodiment, the removable device 825 is a pin or screw, and the spring includes a hook or eyelet 480 which will come into contact with the pin 825 in order to prevent the spring from unscrewing. A portion of the pin may be threaded so that it can be securely attached to the adapter, and easily removed whenever the mailbox owner wants to replace the spring (or tighten the spring), or disassemble the adapter for any other reason. The hook or eyelet 480 is also useful even if glue or caulk is used at one or both ends of the spring, instead of using the pin 825, because the hook or eyelet will provide an additional surface to which the glue or caulk can adhere.

This present description of the invention has been provided by way of examples and illustrations. Those skilled in the art will perceive that many alterations could be made without changing the essential nature of the invention. It is to be understood that all of the present Figures, and the accompanying narrative discussions of the best mode embodiment, do not purport to be completely rigorous treatments of the method and system under consideration. A person skilled in the art will understand that the steps and signals of the present application represent general cause-and-effect relationships that do not exclude intermediate interactions of various types, and will further understand that the various steps and structures described in this application can be implemented by a variety of different combinations of hardware and software which need not be further detailed herein.

What is claimed is:

1. An adapter for use in cooperation with a post, sign post, or other supporting post, the adapter comprising:

an upper adapter portion, for attachment to a first part of the post;

a lower adapter portion, for attachment to a second part of the post; and a cylindrically helical spring for connecting the upper adapter portion to the lower adapter portion so as to allow relative movement between the upper and lower adapter portions if a force is applied to the first part of the post, wherein at least one of the upper and lower adapter portions is shaped to receive the helical spring, wherein the upper adapter portion and the lower adapter portion have facing surfaces which include a plurality of protuberances and corresponding indentations for aligning the adapter portions, and wherein the upper and lower adapter portions are shaped substantially identical to each other.

2. The adapter of claim 1, wherein the upper and lower adapter portions each include a plurality of holes for removably screwing or nailing the adapter to the post.

3. The adapter of claim 1, further comprising a shield for encircling and protecting at least the helical spring during the relative movement.

4. The adapter of claim 1, wherein the upper and lower adapter portions are shaped to receive the respective parts of the post.

5. The adapter of claim 1, wherein one or more of the adapter portions is secured to the helical spring using glue or caulk.

6. The adapter of claim 1, wherein the force applied to the first part of the post creates a torque between the upper and lower adapter portions greater than a pre-determined amount.

7. The adapter of claim 1, wherein the spring has a tension that depends upon how far it is screwed into the at least one of the upper and lower adapter portions.

8. The adapter of claim 3, wherein the upper adapter portion and the lower adapter portion have respective facing elements located outside the shield, for preventing the post from bending in a direction of the facing elements.

9. The adapter of claim 1, wherein the at least one of the adapter portions includes a removable device for securing the spring to prevent unscrewing.

10. The adapter of claim 9, wherein the removable device comprises a screw.

11. The adapter of claim 9, wherein the removable device is for securing the spring in any of a plurality of screwed positions causing the cylindrically helical spring to have a corresponding plurality of different tensions.

12. The adapter of claim 9, wherein an end of the helical spring has a hook, bend, or eyelet for contacting the removable device.

13. An adapter for use in cooperation with a post, sign post, or other supporting post, the adapter comprising:

an upper adapter portion, for attachment to a first part of the post;

a lower adapter portion, for attachment to a second part of the post; and a cylindrically helical spring for connecting the upper adapter portion to the lower adapter portion so as to allow relative movement between the upper and lower adapter portions if a force is applied to the first part of the post, wherein at least one of the upper and lower adapter portions is shaped to receive the helical spring, wherein the upper and lower adapter portions are shaped to receive the respective parts of the post, the adapter further comprising a bracing piece, the bracing piece having an end that is securable to the first part of the post, and the bracing piece also having a protuberance that is alignable with a corresponding indentation in the lower adapter portion.

14. An adapter for use in cooperation with a post, sign post, or other supporting post, the adapter comprising:

an upper adapter portion, for attachment to a first part of the post;

a lower adapter portion, for attachment to a second part of the post; and a cylindrically helical spring for connecting the upper adapter portion to the lower adapter portion so as to allow relative movement between the upper and lower adapter portions if a force is applied to the first part of the post, wherein at least one of the upper and lower adapter portions is shaped to receive the helical spring, wherein the upper and lower adapter portions are shaped to receive the respective parts of the post, the adapter further comprising a bracing piece, the bracing piece having an end that is securable to the second part of the post, and the bracing piece also having a protuberance that is alignable with a corresponding indentation in the upper adapter portion.

* * * * *